US006834399B1

(12) United States Patent
Lo

(10) Patent No.: US 6,834,399 B1
(45) Date of Patent: Dec. 28, 2004

(54) PRESSURE VESSEL

(75) Inventor: Tsung-Yi Lo, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 0 days.

(21) Appl. No.: 10/791,767

(22) Filed: Mar. 4, 2004

(51) Int. Cl.[7] ..... E03D 3/10
(52) U.S. Cl. ..... 4/354; 4/359; 4/380; 4/405
(58) Field of Search ..... 4/354, 359, 361, 4/362, 378–380, 405, 410, 411, 415

(56) References Cited

U.S. PATENT DOCUMENTS 5,652,969 A * 8/1997 Taylor ..... 4/359
5,802,628 A * 9/1998 Spoeth et al. ..... 4/359

* cited by examiner

*Primary Examiner*—Tuan Nguyen
(74) *Attorney, Agent, or Firm*—Troxell Law Office PLLC

(57) ABSTRACT

A pressure vessel has a tank portion for preserving water and a drain mechanism mounted on the tank portion. An outlet is defined at a bottom of the tank portion for draining water. A through hole is defined at a top of the tank portion and corresponding to the outlet for mounting the drain mechanism thereon. The drain mechanism includes a hollow pipe and a separating plate extending horizontally from an inner side and near a top of the hollow pipe. An actuator is assembled on a top of the separating plate for manual operation and has a first resilient element mounted therein. At least a pivot element pivotably connects with the actuator and each forms an anchor at a lower end thereof. A pole extends longitudinally through an interior of the hollow pipe. The pole forms a flange at a top thereof, and defines at least a groove near the flange for latching the anchors. A drain tube is mounted on a bottom of the pole and has a tapered projection substantially at the middle thereof for abutting against the tank portion thereby closing the outlet. A resisting ring is mounted on the drain tube and has an outer rim fixedly retained between the hollow pipe and the drain tube. A biasing ring is mounted on a top of the drain tube and presses against an inner rim of the resisting ring. The pressure vessel has a simplified structure and is easily assembled/disassembled.

9 Claims, 7 Drawing Sheets

PRESSURE VESSEL

BACKGROUND OF THE INVENTION

1. Field of the Invention

The present invention relates to a pressure vessel, and particularly to a pressure vessel with enhanced water pressure for flushing a toilet bowl.

2. Related Art

It often takes over 20 liter water, even 30 liter, to wash an early pressure vessel. Nowadays washing water is reduced vastly to up to 9 liter. In developed countries and countries short of water resource, washing water is limited to 6 liter, even 4.5 liter. With environment protection becomes outstanding, there is a tendency to develop toilet bowl which costs less washing water.

People design a variety of pressure vessels to save washing water for toilet bowls. As shown in FIG. 7, a conventional pressure vessel consists of a tank portion 60 and a draining mechanism 70 assembled on the tank 60. The tank 60 is filled with water for pressing. The draining mechanism 70 empties water in the tank 60 to wash the toilet bowl (not shown).

The draining mechanism 70 comprises a support ring 71 arranged in a top of the tank 60. A locking ring 72 is fastened at a bottom of the support ring 71 by screw, and a film 73 is sandwiched between the locking ring 72 and the hollow ring 71. A water pipe 74 is located below the hollow ring 71. A slide tube 75 is movable along an inner surface of the water pipe 74, and forms a neck 751 around a top thereof and a valve 752 at a middle thereof.

A pole 76 extends through interior of the support ring 71. An actuator 77 is fixed on a top of the pole 76, and a control post 78 is fastened on a bottom of the pole 76 by screw. A spring 80 is arranged between the pole 76 and the actuator 77. A screw spring 79 surrounds peripheral of the pole 76. The control post 78 forms an expanded portion 781 at a middle thereof for abutting against the neck 751 of the slide tube 75.

When the actuator 77 is pressed down, the pole 76 drives the control post 78 to move downwardly, and the expanded portion 781 disengages from the neck 751. Water in the water pipe 74 flows through a void between the expanded portion 781 and the neck 751. Subsequently, the slide tube 75 moves upwardly because of water pressure, and the valve 752 moves to open an outlet 601 of the tank 60. Thus, water in tank 60 is drained to wash the toilet bowl.

In this design, water stored in the water pipe 74 flows through a void between the slide tube 75 and the water pipe 74, making pressure in the water pipe 74 decreases. The slide tube 75 moves upwardly because of water pressure of the tank 60, correspondingly, the valve 752 moves to open the outlet 601. However, at the beginning of operation, water stored in the water pipe 74 is little, so instant water drained from the water pipe 74 is relatively little, which lowering washing effect.

Moreover, a user has to arduously press the actuator 77 downwardly to drive the pole 76 and the control post 78 to move downwardly, and then expanded portion 781 disengages from the neck 751 to allow water to drain from the water pipe 74. The spring 80 has a certain of rigidity to retain the expanded portion 781 and the neck 751 engaging with each other reliably in unused state, and therefore it is hard to press the actuator 77.

Additionally, the draining mechanism 70 has many elements, resulting in high cost and complicated structure.

On the other hand, assembly and disassembly is inconvenient, so maintenance is difficult.

A pressure vessel overcoming the above deficiencies is desired.

SUMMARY OF THE INVENTION

Accordingly, an object of the present invention is to provide a pressure vessel which instantly drains a large number of water for washing a toilet bowl, and separates and adjusts water to promote washing effect.

Another object of the present invention is to provide a pressure vessel which is conveniently actuated.

A further object of the present invention is to provide a pressure vessel which has simple structure and is easily assembled/disassembled.

The pressure vessel of the present invention comprises a tank portion for preserving water. An outlet is defined at a bottom of the tank portion. A through hole is defined at a top of the tank portion and corresponding to the outlet for mounting a drain mechanism thereon.

The drain mechanism includes a hollow pipe with a top fixed on the through hole of the tank portion. A separating plate extends horizontally from an inner side and near a top of the hollow pipe. An actuator is assembled on a top of the separating plate for manual operation and has a first resilient element mounted therein. At least a pivot element pivotably connects with the actuator and is mounted between the separating plate and the actuator. Each pivot element forms an anchor at a lower end thereof.

A pole extends longitudinally through an interior of the hollow pipe. The pole forms a flange at a top thereof, and defines at least a groove near the flange for latching the anchors. A drain tube is mounted on a bottom of the pole by screw. A top projection is formed near a top of the drain tube. A plurality of drain holes is defined in the bottom of the drain tube. A tapered projection is formed at substantially a middle of the drain tube for abutting against the tank portion thereby closing the outlet.

A resisting ring is mounted on the top projection and forms a crinkle portion on a center thereof. The resisting ring has an outer rim fixedly retained between a lower portion of the hollow pipe and a lock cover of the top projection. A biasing ring is mounted on a top of the drain tube by screw and presses against an inner rim of the resisting ring.

The feed mechanism has a housing and a piston movable in the housing. The piston forms an upper block with relatively large width and a lower block with relatively small width, which fit with an inner surface of the housing, respectively. A cavity is defined among the upper block, the lower block and the housing. A second resilient element surrounds the lower block and is accommodated in the cavity. In normal state, the second resilient element has a top abutting against a bottom of the upper block, and a bottom abutting against the housing.

A fastening element is mounted on a top of the housing by screw and defines an air hole substantially in a center thereof. An air room is defined between the fastening element and the upper block and communicates with the air hole. An air tube connects with the air aperture and the air hole for guiding compressed air in the tank portion into the air room.

The tank portion forms a tapered rim at a center of a bottom thereof for bordering the outlet. The tapered projection of the drain tube forms a tapered surface abutting against the tapered rim thereby closing the outlet.

A cross portion is formed at a bottom of the drain tube for separating and adjusting water.

The housing further has an entering portion extending from a bottom thereof for transferring water into the tank portion. An outer tapered surface is formed on a bottom of the lower block for abutting against an inner tapered surface of the entering portion thereby controlling water flow.

The first and the second resilient elements are springs.

DESCRIPTION OF THE PREFERRED EMBODIMENTS

Figure 1:
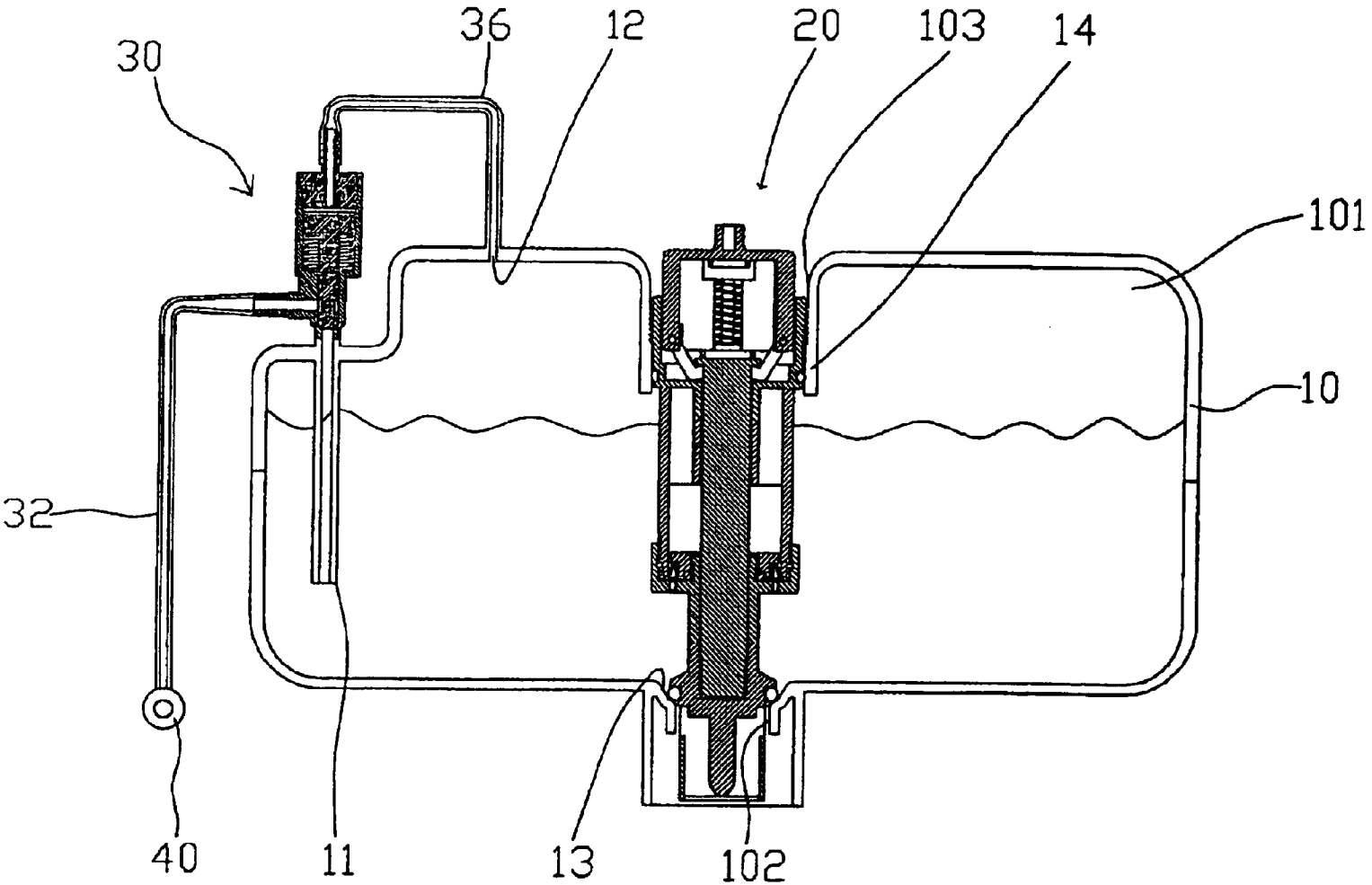
FIG. 1 is an assembled and cross-sectional view of a pressure vessel according to the present invention.

With reference to FIGS. 1 to 5, a pressure vessel 1 in accordance with the present invention comprises a tank portion 10, a drain mechanism 20 assembled on substantially a middle of the tank portion 10, and a feed mechanism 30 assembled on and near a side of the tank portion 10.

The tank portion 10 is hollow and has a chamber 101 for preserving water therein. An air aperture 12 is defined at a top of the tank portion 10. A feed tube 11 is extended into the tank portion 10 from a top thereof and remaining a predetermined length in the chamber 101. The feed tube 11 has an upper portion beyond the chamber 101 for communicating with the feed mechanism 30. The feed mechanism 30 connects with a water resource 40 for providing water to the tank portion 10.

The tank portion 10 forms a tapered rim 13 at a center of a bottom thereof, and the tapered rim 13 defines an outlet 102 therein. The tank portion 10 forms an assembled portion 14 at a center of a top thereof and corresponding to the outlet 102. A through hole 103 is defined in the assembled portion 14 for mounting the drain mechanism 20 thereon.

Figure 2:
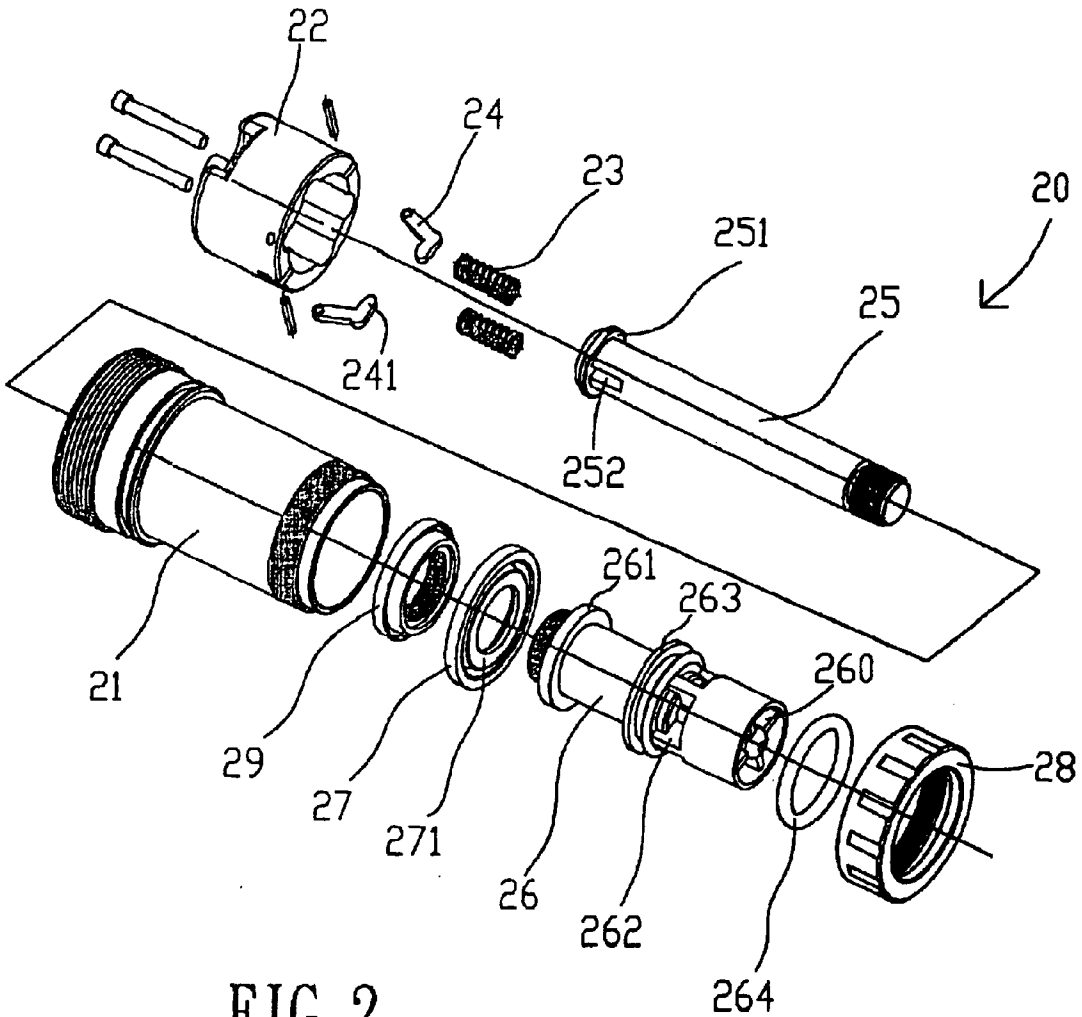
FIG. 2 is an exploded view of a drain mechanism of the pressure vessel of FIG. 1.
Figure 3:
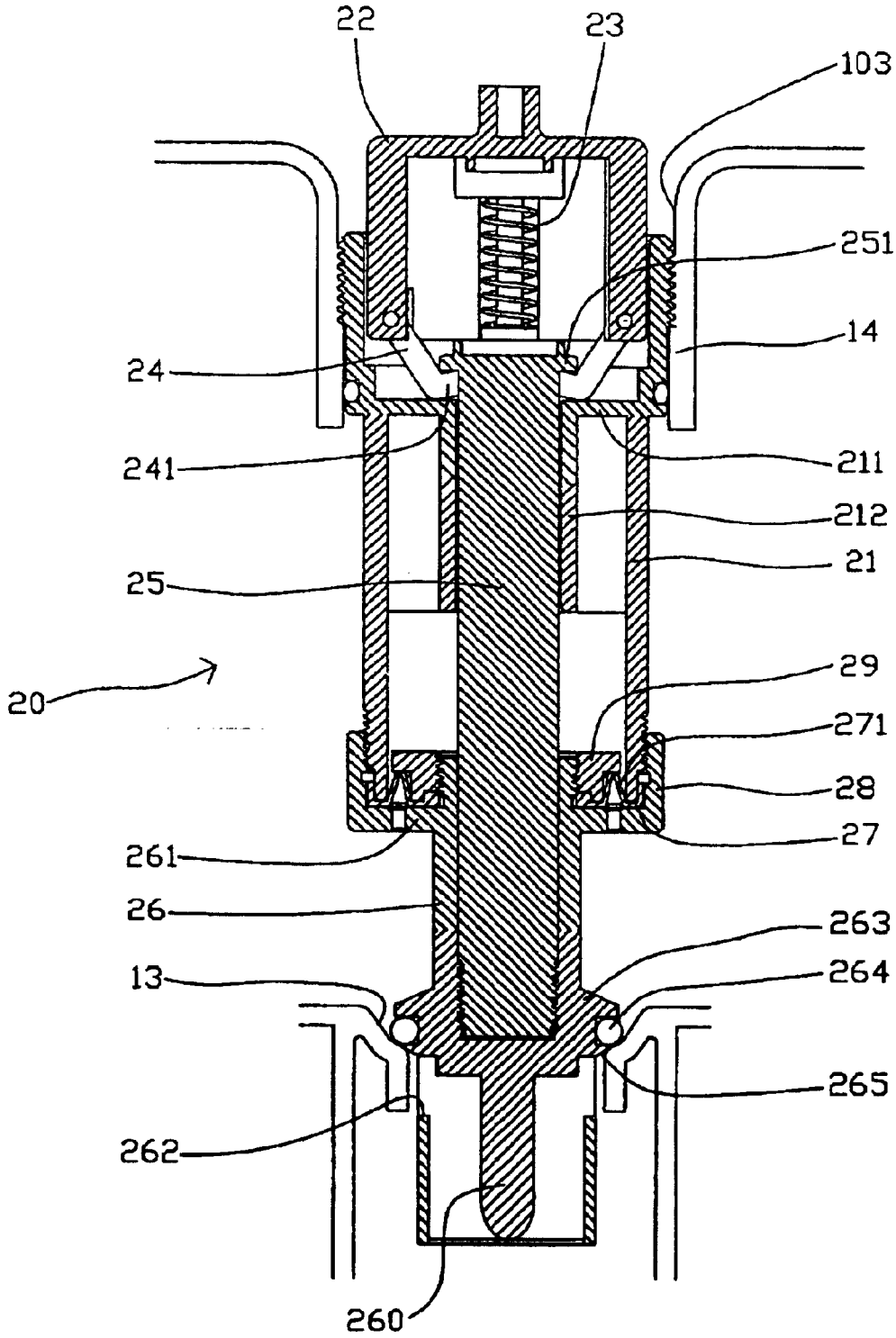
FIG. 3 is an assembled and cross-sectional view of the drain mechanism of FIG. 2.

Referring to FIGS. 2 and 3, he drain mechanism 20 comprises a hollow pipe 21 with a top fixed on the assembled portion 14 by screw. A separating plate 211 extends horizontally from an inner side and near a top of the hollow pipe 21. An inner tube 212 depends perpendicularly from a center of the separating plate 211. An actuator 22 is assembled on a top of the separating plate 211 for manual operation. A pair of pivot elements 24 pivotably connects with the actuator 22 and is mounted between the separating plate 211 and the actuator 22. Each pivot element 24 forms an anchor 241 at a lower end thereof. A first resilient element 23 is mounted in the actuator 22, and in one embodiment the first resilient element 23 is a spring.

A pole 25 extends longitudinally through an interior of the inner tube 212 and the hollow pipe 21. The pole 25 forms a flange 251 at a top thereof, and defines a pair of grooves 252 near the flange 251 for latching the anchors 241.

A drain tube 26 is mounted on a bottom of the pole 25 by screw, and forms a cross portion 260 at a bottom thereof for guiding water to drain and separating and adjusting water flow. A top projection 261 is formed near a top of the drain tube 26. A plurality of drain holes 262 is defined in the bottom of the drain tube 26. A tapered projection 263 is formed at substantially a middle of the drain tube 26 and receives an O-shaped ring 264. The tapered projection 263 forms a tapered surface 265 abutting against the tapered rim 13 of the tank portion 10 thereby closing the outlet 102.

A resisting ring 27 is mounted on the top projection 261 and forms a crinkle portion 271 on a center thereof. A lock cover 28 extends perpendicularly from a peripheral of the top projection 261 and abuts against a lower portion of the hollow pipe 21. The resisting ring 27 has an outer rim fixedly retained between a lower portion of the hollow pipe 21 and the lock cover 28. A biasing ring 29 is mounted on a top of the drain tube 26 by screw and presses against an inner rim of the resisting ring 27.

Figure 4:
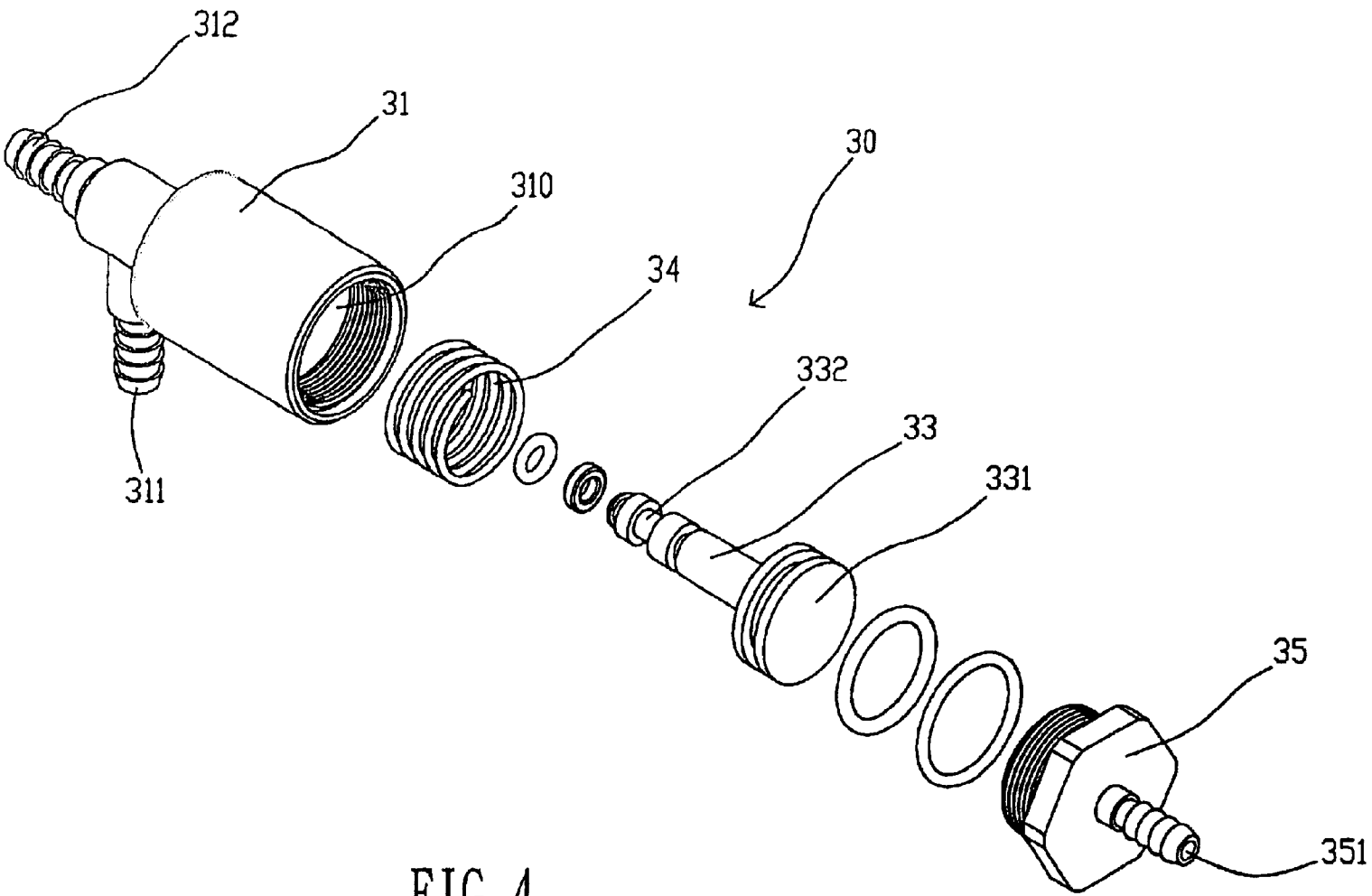
FIG. 4 is an exploded view of a feed mechanism of the pressure vessel of FIG. 1.
Figure 5:
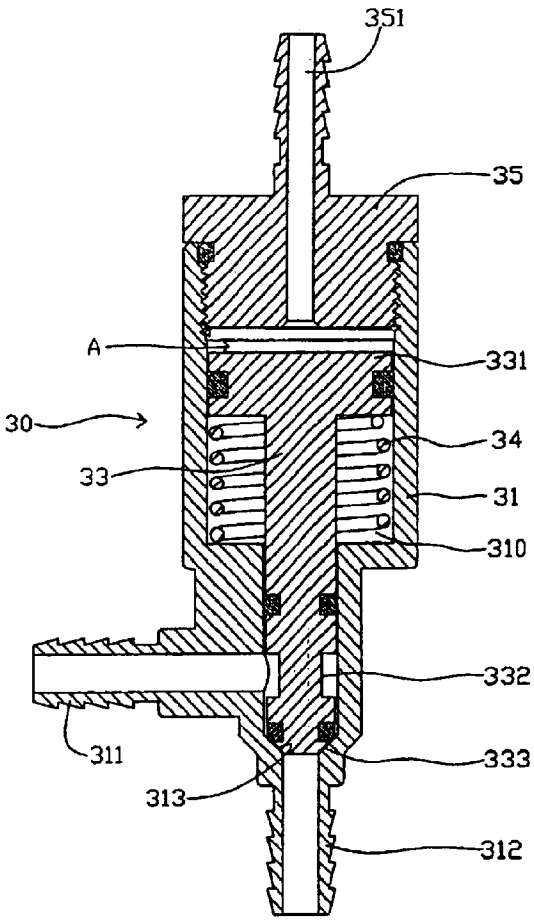
FIG. 5 is an assembled and cross-sectional view of the feed mechanism of FIG. 4.

Referring to FIGS. 4 and 5, the feed mechanism 30 has a housing 31 and a piston 33 movable in the housing 31. The housing 31 has a feed portion 311 perpendicularly extending from a side thereof for connecting with water resource 40, and an entering portion 312 extending from a bottom thereof for connecting with the feed tube 11 to transfer water into the tank portion 10. The piston 33 forms an upper block 331 with relatively large width and a lower block 332 with relatively small width, which fit with an inner surface of the housing 31, respectively. A cavity 310 is defined among the upper block 331, the lower block 332 and the housing 31. An outer tapered surface 333 is formed on a bottom of the lower block 332 for abutting against an inner tapered surface 313 of the entering portion 312 thereby controlling water flow. A second resilient element 34 surrounds the lower block 332 and is accommodated in the cavity 310. In one embodiment the second resilient element 34 is a spring. In normal state, the second resilient element 34 has a top abutting against a bottom of the upper block 331, and a bottom abutting against the housing 31.

A fastening element 35 is mounted on a top of the housing 31 by screw and defines an air hole 351 substantially in a center thereof. An air room A is defined between the fastening element 35 and the upper block 331 and communicates with the air hole 351. An air tube 36 connects with the air aperture 12 and the air hole 351 for guiding compressed air in the tank portion 10 into the air room A.

Figure 6:
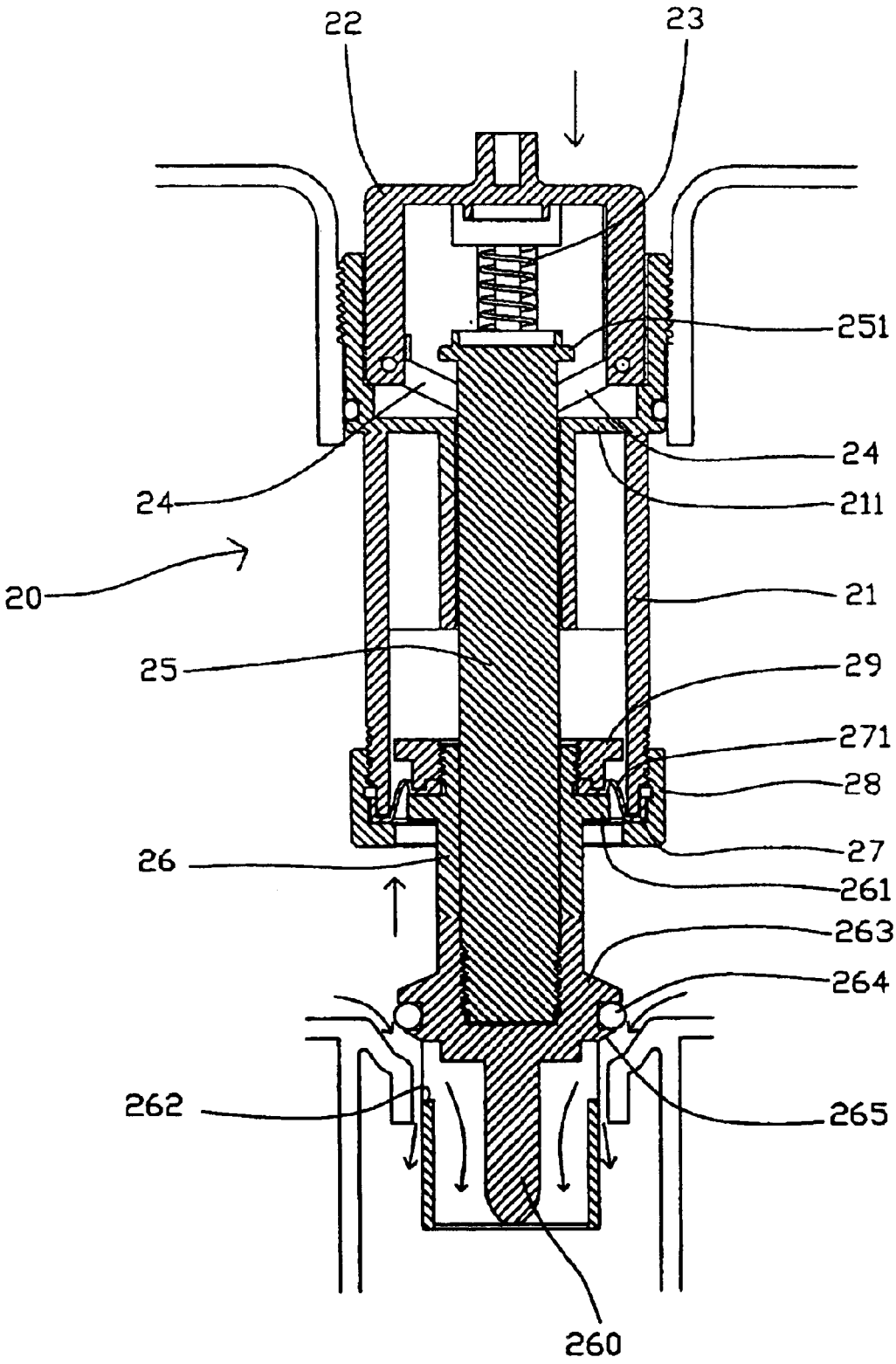
FIG. 6 conceptually shows an exemplary draining operation of the pressure vessel of FIG. 1.
Figure 7:
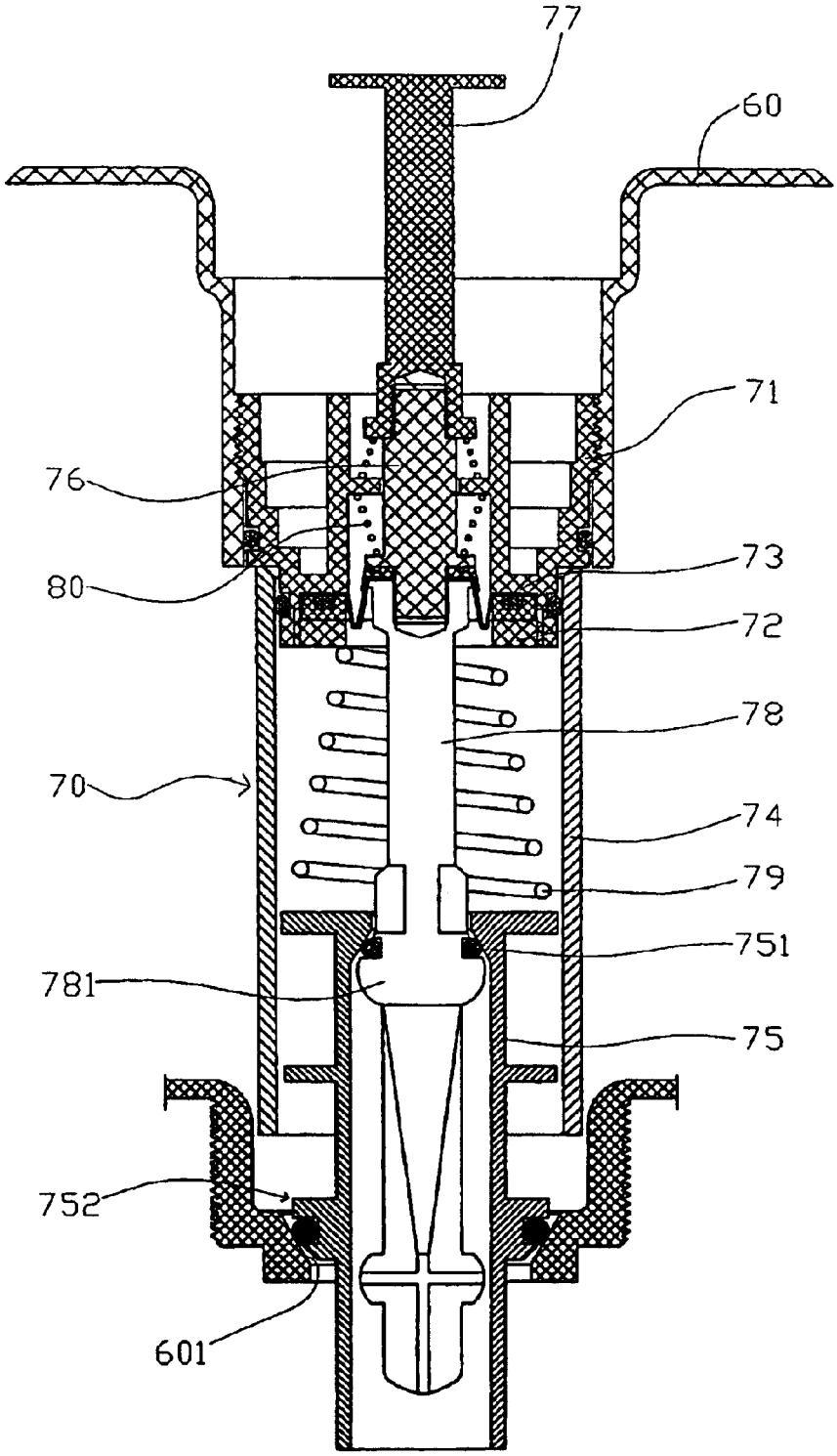
FIG. 7 (Prior Art)
FIG. 7 is a cross-sectional view of a conventional pressure vessel.

Further referring to FIG. 6, in use, the actuator 22 is pressed down. The pivot elements 24 rotate, and the anchors 241 actuate the pole 25 to move upwardly. Correspondingly, the pole 25 takes the drain tube 26 to move upwardly and pulls up the crinkle portion 271 of the resisting ring 27. The tapered surface 265 of the tapered projection 263 disengages from the tapered rim 13 of the tank portion 10 thereby opening the outlet 102 and draining the water in the tank portion 10 downwardly into a toilet bowl (not shown).

When the anchors 241 drive the pole 25 to move upwardly, the top projection 261 of the drain tube 26 balances water pressure, and therefore water pressure in the tank portion 10 actuates the drain tube 26 to move upwardly, thereby allowing external pressure on the actuator 22 to decrease.

The tapered projection 263 disengages from the tapered rim 13 of the tank portion 10 to open the outlet 102, consequently water in the tank portion 10 is rapidly drained. A large number of instant water assures effective washing of the toilet bowl. Furthermore, The cross portion 260 of the drain tube 26 separates and adjusts water flow.

When external pressure on the actuator 22 is removed, the first resilient element 23 drives the actuator 22 to return back. Meanwhile the pole 25 moves downwardly by the resilient pressure of the resisting ring 27. Finally the tapered surface 265 of the drain tube 26 automatically closes the outlet 102.

At the same time pressure in the tank portion 10 reduces, making piston 33 of the feed mechanism 30 move. Sequentially the lower block 332 moves to open the entering portion 312 and water resource 40 provides water to the tank portion 10 through the feed portion 311 of the feed mechanism 30.

Once pressure in the tank portion 10 reduces to a predetermined value, compressed air in the tank portion 10 flows through the air aperture 12, the air tube 36, the air hole 351 and into the air room A, thereby making the upper block 331 to move downwardly. The lower block 332 moves to close the entering portion 312 thereby stopping water into the tank portion 10.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A pressure vessel adapted for providing water to wash a toilet bowl comprising:

a tank portion for preserving water, an outlet being defined at a bottom of the tank portion for draining water, and a through hole being defined at a top of the tank portion and corresponding to the outlet; and a drain mechanism including:

a hollow pipe with a top fixed on the through hole of the tank portion, a separating plate extending horizontally from an inner side and near a top of the hollow pipe, an actuator being assembled on a top of the separating plate for manual operation and having a first resilient element mounted therein, at least a pivot element pivotably connecting with the actuator and mounted between the separating plate and the actuator, each pivot element forming an anchor at a lower end thereof;

a pole extending longitudinally through interior of the hollow pipe, and forming a flange at a top thereof, at least a groove being defined near the flange for latching the anchors, a drain tube being mounted on a bottom of the pole and having a top projection near a top thereof, a plurality of drain holes in the bottom thereof and a tapered projection at substantially a middle thereof for abutting against the tank portion thereby closing the outlet; and a resisting ring being mounted on the top projection of the drain tube and forming a crinkle portion on a center thereof, the resisting ring having an outer rim fixedly retained between a lower portion of the hollow pipe and a lock cover of the top projection, a biasing ring being mounted on a top of the drain tube for pressing against an inner rim of the resisting ring.

2. The pressure vessel as claimed in claim 1, further comprising a feed mechanism assembled on and near a side of the tank portion.

3. The pressure vessel as claimed in claim 2, wherein the feed mechanism has a housing, the housing having a feed portion perpendicularly extending from a side thereof for connecting with water resource, and an entering portion extending from a bottom thereof for transferring water into the tank portion, and wherein a feed tube extends into the tank portion and has an upper portion beyond a top of the tank portion for communicating with the entering portion of the feed mechanism.

4. The pressure vessel as claimed in claim 3, wherein the feed mechanism has a piston movable in the housing, and forms an upper block with relatively large width and a lower block with relatively small width, which respectively fit with an inner surface of the housing, a second resilient element surrounding the lower block and having a top abutting against the upper block and a bottom abutting against the housing in normal state.

5. The pressure vessel as claimed in claim 4, wherein a fastening element is mounted on a top of the housing and defines an air hole substantially in a center thereof, an air room being defined between the fastening element and the upper block and communicating with the air hole, and wherein an air tube connects with the air aperture and the air hole for guiding compressed air in the tank portion into the air room.

6. The pressure vessel as claimed in claim 4, wherein the first and the second resilient elements are springs.

7. The pressure vessel as claimed in claim 4, wherein an outer tapered surface is formed on a bottom of the lower block for abutting against an inner tapered surface of the entering portion thereby controlling water flow.

8. The pressure vessel as claimed in claim 1, wherein the tank portion forms a tapered rim at a center of a bottom thereof for bordering the outlet, and wherein the tapered projection forms a tapered surface abutting against the tapered rim thereby closing the outlet.

9. The pressure vessel as claimed in claim 1, wherein a cross portion is formed at a bottom of the drain tube for separating and adjusting water.

* * * * *